US007878733B2

(12) United States Patent
Atkinson

(10) Patent No.: US 7,878,733 B2
(45) Date of Patent: Feb. 1, 2011

(54) EROSION PROTECTION DEVICE

(76) Inventor: Francis Stewart Atkinson, 1011/196 Surf Parade, Surfers Paradise, Queensland (AU) 4217

( * ) Notice: Subject to any disclaimer, the term of this patent is extended or adjusted under 35 U.S.C. 154(b) by 0 days.

(21) Appl. No.: 12/524,014

(22) PCT Filed: Mar. 11, 2008

(86) PCT No.: PCT/AU2008/000340

§ 371 (c)(1),
(2), (4) Date: Jul. 22, 2009

(87) PCT Pub. No.: WO2008/109944

PCT Pub. Date: Sep. 18, 2008

(65) Prior Publication Data

US 2010/0104368 A1 Apr. 29, 2010

(30) Foreign Application Priority Data

Mar. 13, 2007 (AU) ..... 2007901263

(51) Int. Cl.
*E02B 3/12* (2006.01)

(52) U.S. Cl. ..... 405/29; 405/33; 405/25

(58) Field of Classification Search ..... 405/15, 405/16, 17, 21, 25, 29, 34, 35
See application file for complete search history.

(56) References Cited

U.S. PATENT DOCUMENTS 3,252,287 A 5/1966 Suzuki
3,380,253 A 4/1968 Vita
3,614,866 A 10/1971 Kaneko et al.
5,190,403 A 3/1993 Atkinson
5,620,280 A * 4/1997 Melby et al. ..... 405/29
6,401,421 B1 * 6/2002 Zeman ..... 405/16
7,160,057 B2 * 1/2007 Reedijk et al. ..... 405/29

* cited by examiner

*Primary Examiner*—Frederick L Lagman
(74) *Attorney, Agent, or Firm*—David A. Guerra

(57) ABSTRACT

An erosion protection device is described which is made of two or more components. Each component has an edge, surfaces on respective sides of the edge and at least one joining portion (a joining portion of a component comprises a recess in the edge and receiving portions on respective sides of the edge). Each recess has a base which is indented relative to the edge, and sidewalls which diverge as they extend from the base out to the edge. The receiving portions diverge relative to each other with the same slope as the sidewalls as they extend from adjacent the base of the recess away from the edge towards the respective surfaces. When joining two components together, a bonding medium is applied to the joining portion on one or both components. The joining portions are then brought together such that the space between the sidewalls and receiving portions of one component and the receiving portions and sidewalls respectively of the other component diminishes thereby squeezing the bonding medium therebetween as the components come together.

20 Claims, 4 Drawing Sheets

EROSION PROTECTION DEVICE

CROSS-REFERENCE TO RELATED APPLICATIONS

This application is an U.S. national phase application under 35 U.S.C. §371 based upon co-pending International Application No. PCT/AU2008/000340 filed on Mar. 11, 2008. Additionally, this U.S. national phase application claims the benefit of priority of co-pending International Application No. PCT/AU2008/000340 filed on Mar. 11, 2008 and Australia Application No. 2007901263 filed on Mar. 13, 2007. The entire disclosures of the prior applications are incorporated herein by reference. The international application was published on Sep. 18, 2008 under Publication No. WO 2008/109944.

FIELD OF THE INVENTION

The present invention relates to devices (sometimes referred to as "armour units") used in protecting or reinforcing beaches, river/creek banks, breakwaters, and other natural and man-made structures against water erosion.

BACKGROUND

U.S. Pat. No. 5,190,403 to the present inventor provides the following introduction to the problem of water erosion:

The interface of land and water presents serious erosion, or land loss problems. In particular, where waves impact land structures, such as beaches or promontories, the wave energy can disturb the land structure causing the land to erode into the water. The damage caused by this action can take years to accrue, such that the day to day or month to month change is imperceptible, or the damage can be seen in a matter of days where high water or unusually fierce storms generate very high waves.

Where the beach or land adjacent a body of water [or a watercourse] erodes, valuable real estate and improvements may be permanently lost, or the land may be rendered unsuitable for improvements. Ocean and lakefront property [and likewise riverside and even creek-front property] is very valuable. Thus, the constant erosion of land adjacent these waters is a costly problem. Further, where the erosion problem is caused by currents, waves or eddies undercutting banks, shorelines or mounting structures, serious damage to the structures adjacent the undercutting can occur. For example, where a jetty or pier is constructed outward into a body of water, currents and eddies can undermine the soil structure at the lake, river or seabed adjacent the footings or pilings which support the structure. The resulting erosion can undermine the integrity of the structure, requiring filling of the eroded area and repair of the structure and footings or pilings.

In order to address this problem, U.S. Pat. No. 5,190,403 describes a multi-legged erosion protection device designed to be used with other similar or identical devices to create a flexible and supportive matrix structure. The matrix can be formed by assembling the devices together randomly or alternatively in a uniform pattern. In either case the multi-legged configuration of the devices enables interlocking or "nesting" between the respective devices to form the matrix structure for reinforcing a water/land interface (e.g. beach, breakwater, river bank etc). The matrix structure created in this way can be dense, secure and flexible enough to absorb and reflect the energy of waves or water flows, thereby preventing the waves or water flows from dislodging or eroding the land protected/reinforced by the structure.

In addition to being dense and supportive as just described, the matrix structure of interlocking devices is also highly permeable with void spaces inside and extending through the matrix. These voids provide habitat for fish and other marine life when the structure is used as a reef or breakwater in river, lake and/or coastal applications. Alternatively, where the structure is applied to reinforce a riverbank or the like, the voids can allow back filling with soil to enable roots to penetrate and plants and vegetation to grow in/over/around the supporting structure to (re-)vegetate the bank.

The preferred form of the multi-legged device (armour unit) described in U.S. Pat. No. 5,190,403 is shown in FIG. 1 and is shaped like a jack (i.e. like one of the 6 pointed items used in the traditional game of "Jacks"). The armour units are typically made of concrete. The commonly produced sizes of armour units range from very small units with a volume of around 0.016 $m^3$ and a weight of approximately 36 kg to very large units having a volume of approximately 2 $m^3$ and a weight of approximately 4600 kg. Even larger units weighing up to 20 tonnes have been (and may continue to be) produced and used as well. The small units are typically used in applications such as stream bank restoration, whereas the larger units are generally used for energy dissipation and ocean applications.

FIG. 1 shows that each armour unit 1 is generally symmetrical and has six legs. In FIG. 1, some of the legs are designated 2*a* whilst others are designated 2*b*. The distinction between legs 2*a* and 2*b* will be explained below. All of the legs are approximately the same length and thickness, and they all have a generally square cross-section. In each corner formed by the intersection between a leg 2*a* and a leg 2*b* is a density spacer 3. Each density spacer 3 is a block which is normally integrally formed with the legs of the armour unit 1. The density spacers 3 function to space the placement of the legs of adjacent armour units when a plurality of the armour units are nested together as shown in FIG. 4. In FIG. 4, the units are arranged in a uniform pattern. It is also possible to create a matrix structure (suitable e.g. for use in breakwaters etc) by placing the units randomly as shown in FIG. 13. Some versions of the armour unit may have additional density spacers, for example 3*a* as shown in FIG. 3.

FIG. 2 illustrates that each armour unit 1 is formed from two halves 4. Each half 4 is generally T-shaped with one leg 2*b* forming the stem portion of the T and the other two legs 2*a* together forming the crossbar portion of the T. Both halves 4 are substantially identical. In each half 4, a recessed notch 5 is located in the centre of the top surface of the crossbar portion, between the two legs 2*a*. Each half 4, when made of concrete, is typically formed using a 2-D "cookie cutter" construction. This involves simply pouring concrete into a mould the shape of the half 4 and allowing the concrete to set.

The two-part construction of the preferred versions of the armour units has a number of benefits. Firstly, the "2-D" moulds required to form each of the halves 4 are much cheaper than the "3-D" moulds that would be required to form an armour unit 1 as a single piece. Also, a 3-D mould such as this could not be stripped for a considerable amount of time (perhaps several days for larger units) because the stripping of the mould could not take place until all of the concrete legs and their extremities became self-supporting. In contrast, it can take as little as a few hours after pouring for the concrete to set sufficiently to allow the 2-D moulds to be stripped leaving formed halves 4. Furthermore, multiple individual halves 4 can be much more conveniently stacked together for storage and transportation than could multiple one-piece "Jack" shaped units.

In order to assemble two halves 4 to form an armour unit 1, the halves are placed adjacent each other in a crosswise fashioned (as shown in FIG. 2) such that the legs 2*b* of each half are collinear and the crossbar portions of each half are disposed at right angles to each other. For small units, this can be done by hand, but as noted above, a crane is required to move the halves 4 of larger units. The halves 4 are then brought together as shown by the dashed lines in FIG. 2.

FIG. 3 shows a partially cross-sectional view of the unit 1 immediately after the two halves 4 have been brought together. In FIG. 3, the lower half 4 is shown in a plan orientation. However, the upper half 4 in FIG. 3 (if it were shown in full) would be oriented with the legs 2*a* pointing in and out of the page. Instead, the upper half 4 is shown in cross-sectional view with only the cross-section of its leg 2*b* visible.

From FIG. 3 it can be seen that when the two halves 4 are brought together, a small gap 6 exists between them. This gap exists to allow grout to be injected after the halves have been brought together to bond the halves together. The gap is normally at least 10 mm, this being the minimum space required to allow pourable (or pumpable) grout to be used.

Whilst the preferred version of the armour unit in U.S. Pat. No. 5,190,403 (which is described above with reference to FIGS. 1-4 and 13) has proven to be hugely effective in protecting and/or reinforcing beaches, river banks, breakwaters etc against water erosion, nevertheless certain problems have emerged, particularly in relation to its assembly and quality control.

One of the problems relates to the amount of grout required to bond the individual halves together. It will be appreciated that a large (or sometimes very large) quantity of grout can be required to fill the entire void 6, particularly for large armour units. This can significantly increase the material requirements (and hence the cost) of constructing the armour units. It can also significantly increase the time required to assemble the units as time is required to pour/pump the grout in and allow it to set—the more grout needed to be used, the more time is required.

A related problem arises where the units are assembled and used in poor/developing parts of the world. It will be appreciated that, even though the process of slotting the halves 4 together and pouring/pumping grout into the gap 6 is relatively simple, nevertheless it requires skilled execution as well as the use of high-quality grouting materials. In poor/developing parts of the world there is sometimes a tendency to use poorer quality materials in an effort to save cost. However, the use of poor quality grouting materials in this application jeopardises the integrity of the armour unit.

Another problem arises because, before they are bonded together by the grout, the individual halves 4 can be quite fragile. In particular, the manipulating and wiggling that often occurs when workers attempt to slot the two halves 4 together can cause outward bending and/or impact loads on the parallel sidewalls of the notches 5. These loads can induce stresses (including potentially damaging tensile stresses) in the concrete. This can be a problem particularly near the corners 7 identified in FIG. 3 which create regions of potentially high stress concentration. Consequently, with the configuration of the halves shown in FIGS. 2-3 there is an increased risk of fracture in and around the planes A-A due to the above-mentioned stress concentrations. This fragility reduces considerably when the grout sets to firmly bond the halves together forming a single unit with a solid core of grout and concrete at the centre.

It is an object of the invention to provide an improved erosion protection device which helps to address one or more of the above-mentioned problems, or which at least provides a useful or commercial alternative to existing devices in the marketplace.

It will be clearly appreciated that any reference herein to previous or conventional methods, devices, practices, or other information (including publications) does not constitute an acknowledgement or admission that any methods, devices, practices or other information (including publications), or any possible combination thereof, formed part of the common general knowledge in the field, or is otherwise admissible prior art, whether in Australia or in any other country.

DESCRIPTION OF THE INVENTION

In one form, the present invention resides broadly in an erosion protection device made of two or more components, each component having an edge, surfaces on respective sides of the edge and at least one joining portion, wherein a joining portion of a component comprises a recess in the edge and receiving portions on respective sides of the edge, wherein

- each recess has a base which is recessed/indented relative to the edge, and sidewalls (or parts thereof) which diverge as they extend from the base out to the edge, and
- the receiving portions (or parts thereof) diverge relative to each other with substantially the same slope as the sidewalls (or parts thereof) as they extend from adjacent the base of the recess away from the edge towards the respective surfaces, whereby when joining two components a bonding medium is applied to the joining portion on one or both components, and the joining portions are brought together such that space between the sidewalls and receiving portions of one component and the receiving portions and sidewalls respectively of the other component diminishes thereby squeezing the bonding medium therebetween as the components come together.

In this way, the present invention helps to address the problems discussed above concerning the use of grout to join component parts together. In particular, with the present invention, the way the space diminishes thereby compressing the bonding material between the tapering sidewalls of one component and the correspondingly tapering receiving portions of the other component causes excess bonding material to be squeezed out from in-between the components. The excess material can then be "faired-off" (i.e. removed by scraping it off), and potentially reused. This reduces the overall amount of bonding material required. Also, this squeezing helps to ensure that the bonding medium is fully distributed (i.e. squeezed into the nooks and crannies) between the sidewalls of one component and the receiving portions of the other component etc.

For reasons discussed further below, the joining portions of the components should be configured so that, if the joining portions of two components were brought together without applying any bonding material, a small space would remain between the between the sidewalls and receiving portions of one component and the receiving portions and sidewalls respectively of the other component, even when the components come together fully. However, the width of this space should be small—considerably less than 10 mm. Typically, if bonding material were left out, the width of this space would be less than 5 mm, and preferably approximately 2-3 mm. The small size of this gap between the two components, in addition to causing the beneficial squeezing discussed above, also opens up the possibility of using alternative bonding media or materials that could not previously be used. Such alternative bonding materials include (but are not limited to) spray on epoxy, epoxy impregnated fabrics and plastics cements. The quality of these alternative bonding materials can be much more easily controlled than simple grouts because cement type grouts are often mixed on site and therefore it can be easier (as is sometimes done in developing countries) to over-dilute the mix or use substandard ingredients. To avoid confusion, it will be clearly understood that grout may also be used as the bonding medium in the present invention. However, the present invention provides significant advantages compared with previous erosion protection devices like the one described in the background section above because it enables other bonding media to be used as well which do not suffer from the disadvantages associated with grout.

In another aspect, the present invention resides broadly in a component of an erosion protection device, the component having an edge, surfaces on respective sides of the edge and at least one joining portion, the joining portion comprising a recess in the edge and receiving portions on respective sides of the edge, wherein the recess has a base which is recessed/indented relative to the edge, and sidewalls (or parts thereof) which diverge as they extend from the base out to the edge, and the receiving portions (or parts thereof) on respective sides diverge with substantially the same slope as the sidewalls (or parts thereof) as the receiving portions extend from adjacent the base of the recess away from the edge towards the respective side surfaces.

Components in accordance with this aspect of the invention can be joined to other components which have a common joining portion. Hence, as described above, when joining the two components together, a bonding medium is applied to the recess sidewalls and/or receiving portions on one or both components, and the joining portions of the two components are brought together such that space between the sidewalls and receiving portions of one component and the receiving portions and sidewalls respectively of the other component diminishes thereby squeezing the bonding medium therebetween as the components come together.

A further aspect of the invention resides broadly in a join between two components of an erosion protection device, each component having an edge, surfaces on respective sides of the edge and at least one joining portion, wherein each recess has a base which is recessed/indented relative to the edge, and sidewalls or parts thereof which diverge as they extend from the base out to the edge, and the receiving portions or parts thereof on respective sides diverge with substantially the same slope as the sidewalls or parts thereof as the receiving portions extend from adjacent the base of the recess away from the edge towards the respective side surfaces, whereby a bonding medium is applied to the recess sidewalls and/or receiving portions on one or both components, and the join is formed by bringing the joining portions of the two components together such that space between the sidewalls and receiving portions of one component and the receiving portions and sidewalls respectively of the other component diminishes thereby squeezing the bonding medium therebetween as the components come together.

Erosion protection devices in accordance with or using the present invention are made by joining two or more components together. Typically, the device will be made by joining two components together. However, the invention could equally be applied to devices made from any number of components. Where more than two components are joined together to make the device, some components may connect (and may only be able to connect) with one other component, whereas other components may connect (or may be able to connect) to two or more others. Where a single component connects (or is able to connect) to two or more other components, that component will generally need to have a joining portion for each other component to which it connects (or is able to connect).

It is envisaged that the components used to make the devices will typically be made of concrete. Also, depending on the size of the device (and the components from which it is made), the concrete may also include steel reinforcing. Larger units are likely to require greater reinforcing than smaller units. The use of steel rods or meshes to reinforce the concrete will be well understood by those skilled in the art. Whilst the components will usually be made from concrete, they could also be made from other materials such as wood, steel, iron, plastic or a combination of these or similar materials.

It is expected that devices in accordance with the present invention will be made in a range of sizes, the range being similar to that described in the background section above.

The components from which the erosion protection devices are made will typically be multi-legged components which, when joined together, form multi-legged erosion protection device. Preferably, the multiple legs of the devices may enable the devices to be assembled to form an interlocking matrix structure. The legs of the device may all be the same length and shape, or alternatively different legs may have different shapes and sizes. Particularly preferred embodiments of the invention will be made from two components, each component having a three legged T shape very similar to that described in the background section above. Hence, in these particularly preferred embodiments, the erosion protection device may have a similar overall "jack" shape to that described above.

The components which are used to form the erosion protection device have an edge and surfaces on respective sides of the edge. The edge may be any peripheral portion or part of the component. For example, it may be a simple ridge line between the surfaces, or it may be a surface itself. In any event, no limitation whatsoever is to be implied regarding the nature or configuration of the edge. Regarding the surfaces, if the edge has a configuration that forms an overall straight or curved line, there may be two services, one on either side of the edge. However, it is also possible that there could be multiple distinct surfaces on either side of the edge. Also, it should not be implied that the surfaces necessarily form the "sides" or side faces of the overall component, although they may do in some embodiments.

Each component has a joining portion. The joining portion comprises a recess in the edge and receiving portions on respective sides of the edge. The recess is indented into the edge and will typically resemble a notch, cavity, slot or something similar in the edge. The recess has a base. The base is a portion of the recess which is indented relative to the edge. The base may take a range of forms. Typically, the base will comprise a surface (most typically a flat surface) in the bottom of the recess. However, no particular limitation is meant in this regard, and the base may also take a range of other forms. For example, the base may comprise simply the innermost portion of the recess between the sidewalls.

Generally, there will be two sidewalls on opposing sides of the recess, although the configurations with other numbers of sidewalls are also possible. The sidewalls extend between the base of the recess and the edge of the component. Each sidewall may comprise a single flat or continuously curved surface. Alternatively, multiple separate/distinct surfaces (for example separated by ridge lines) may together form each sidewall. Irrespective of whether each sidewall comprises a single surface or multiple surfaces, each sidewall will have at least a portion which diverges relative to at least a portion of the other sidewall as the walls extend from the indented base of the recess out to the edge of the component. Put another way, the space between respective sidewalls (or at least the respective parts thereof) should be broader closer to the edge of the component and narrower closer to the indented base of the recess.

The joining portion of each component also incorporates receiving portions. When two components are brought together to be joined, the sidewalls of the recess in the first component move over the top of the receiving portions of the second component, and vice versa. As the sidewalls move over the receiving portions, the bonding medium becomes squeezed in between as described above. As also described above, the joining portion of each component should be configured so that if the two components were brought together in the absence of a bonding medium, a small space would remain between the sidewalls of the first component and the receiving portions of the second component, and also between the receiving portions of the first component and the sidewalls of the second component. To achieve this small space, at least for the joining portions of two components designed to be joined together, the shape of the receiving portions must effectively mirror the shape of the sidewalls so that only a small gap remains between them when they are brought together. Hence, for example, if the sidewalls of the recess of one component comprise flat planar surfaces that diverged towards the edge of the component, the receiving portions of the other component should also comprise flat planar surfaces with the same size and diverging slope. In another example, if the sidewalls of the recess of one component comprise curved surfaces, the receiving portions of the other component must comprise curved surfaces of the same size and shape so that only a small gap remains anywhere between them when they come together. In a further example, if the sidewalls of the recess of one component are each formed by multiple distinct surfaces (each of which may be at a slightly different angle), the receiving portions of the other component must be configured with a mirroring shape of multiple distinct surfaces.

In another aspect, the present invention resides broadly in a method for joining two components of an erosion protection device, each component having an edge, surfaces on respective sides of the edge and at least one joining portion, wherein each recess has a base which is recessed/indented relative to the edge, and sidewalls or parts thereof which diverge as they extend from the base out to the edge, and the receiving portions or parts thereof on respective sides diverge with substantially the same slope as the sidewalls or parts thereof as the receiving portions extend from adjacent the base of the recess away from the edge towards the respective side surfaces, the method involving applying a bonding medium to the joining portion on one or both components, and then forming the join by bringing the joining portions of the two components together such that space between the sidewalls and receiving portions of one component and the receiving portions and sidewalls respectively of the other component diminishes thereby squeezing the bonding medium therebetween as the components come together.

In a further aspect, the present invention resides broadly in a method for producing a component of an erosion protection device from a material that can be poured before setting, each component having an edge, surfaces on respective sides of the edge and at least one joining portion, wherein each recess has a base which is recessed/indented relative to the edge, and sidewalls or parts thereof which diverge as they extend from the base out to the edge, and the receiving portions or parts thereof on respective sides diverge with substantially the same slope as the sidewalls or parts thereof as the receiving portions extend from adjacent the base of the recess away from the edge towards the respective side surfaces, the method involving placing an insert into a mould prior to pouring the material, then pouring the material into the mould over that insert, then positioning another insert in the poured material in the mould, and allowing the material to set to form the component before removing it from the mould, wherein the respective inserts shape the receiving portions of the component.

Any steel reinforcing (which may or may not be required depending on the size of the armour unit) may be inserted into the mould in a way that will be well understood by those skilled in this area. Steel hooks or the like may also be positioned in the mould so as to protrude from the moulded component when the concrete sets. These hooks may then be used to lift the component and move it around, which with larger sizes may require the use of a crane or the like.

BRIEF DESCRIPTION OF THE DRAWINGS

In FIGS. 1-6:

FIG. 1 shows the preferred multi-legged prior art device described in U.S. Pat. No. 5,190,403 fully assembled;

FIG. 2 is an exploded view of the multi-legged device of FIG. 1 illustrating the way the halves fit together;

FIG. 3 is a partially cross-sectional view of the unit of FIG. 1 after the two halves have been brought together. The lower half is shown in a plan orientation. The upper half is shown in partial cross-section with only the cross-section of its leg 2*b* visible.

FIG. 4 shows a plurality of the prior art armour units of FIG. 1 arranged in a uniform pattern to create a matrix structure.

FIGS. 5 and 6 are "before and after" photographs of a water course.

FIG. 5 shows the water course before the bank has been reinforced.

FIG. 6 shows the water course after the bank has been reinforced using a matrix structure formed from a plurality of the prior art devices in FIG. 1 and the bank vegetation has been allowed to regrow. These photographs illustrate the effectiveness of erosion protection devices of this general type.

In FIGS. 7-12:

FIG. 7 is a perspective representation of one of the halves used to construct a 6-legged "jack" shaped erosion to protection device in accordance with the present invention.

FIG. 8 is an perspective representation of two of the halves of FIG. 7 which illustrates the way that two halves can be brought together to form the device shown in FIG. 9.

FIG. 9 is a perspective representation of a 6-legged "jack" shaped erosion to protection device in accordance with the present invention when fully assembled from the two halves shown in FIG. 8.

FIG. 10 is a plan view of the half shown in FIG. 7.

FIG. 11 is a cross-sectional view of the unit of FIG. 9 after the two halves have been brought together. The lower half is shown in a cross-sectional plan orientation. The upper half is partially shown in cross-section (only the cross-section of its leg is 20*b* visible). The cross-section of the upper half's leg 20*b* is shaded with dots to distinguish it from the cross-section of the lower half.

FIG. 12 is a side on the view of a "cookie cutter" mould used to form the halves shown in FIG. 7-8.

DETAILED DESCRIPTION OF FIGS. 7-12

Figure 1:
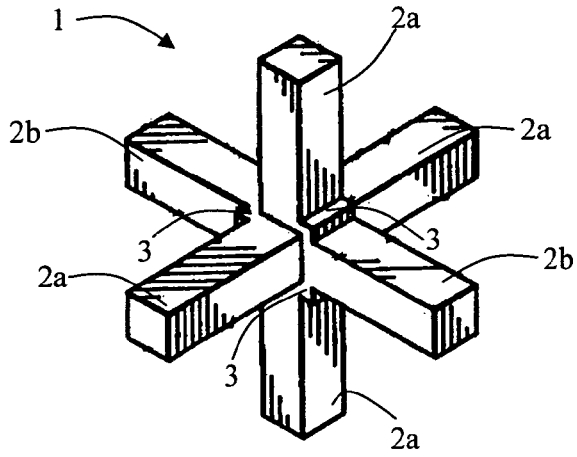
Figure 1 (Prior Art)
FIGS. 1-6 relate to a prior art erosion protection device, namely the preferred form of the multi-legged device (armour unit) described in U.S. Pat. No. 5,190,403. This prior art device was described in the background section above.
Figure 2:
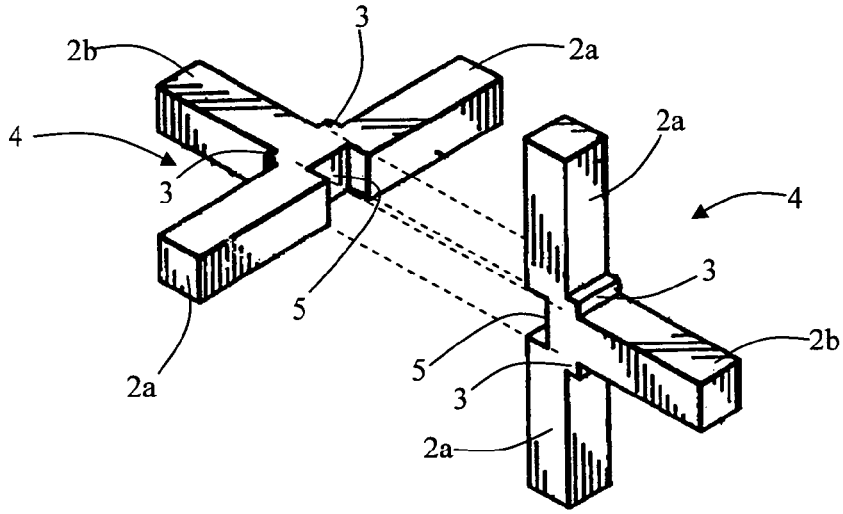
Figure 2 (Prior Art)
Figure 3:
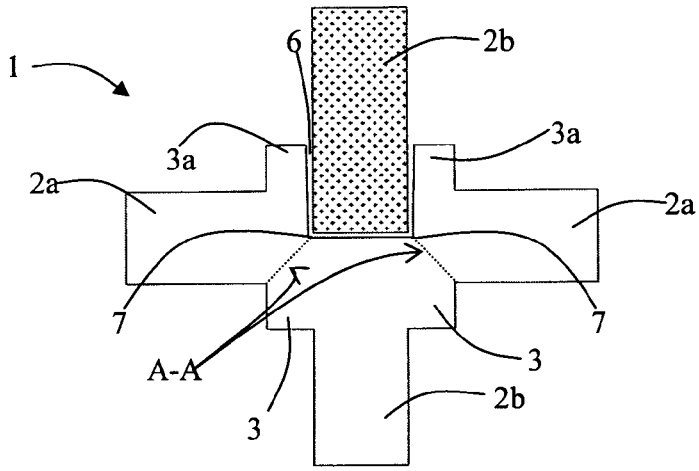
Figure 3 (Prior Art)

As noted above, FIGS. 7-12 relate to an erosion protection device in accordance with one preferred embodiment of the present invention. In this embodiment, the device is a multi-legged armour unit similar in overall shape to the preferred device described in U.S. Pat. No. 5,190,403. It therefore has 6 legs oriented at right angles to each other, giving it a "jack" shape. The various features of the unit shown in FIGS. 7-12 are identified by reference numerals which correspond with the reference numerals used to identify similar features in FIGS. 1-3, except that a "0" is added to the reference numerals in FIGS. 7-12. So, for example, the density spacers described in the background section above are identified in FIGS. 1-3 by reference numerals 3 and 3*a*, whereas the density spacers in FIGS. 7-12 are identified by reference numerals 30 and 30*a*.

Like the preferred version of the device from U.S. Pat. No. 5,190,403, the armour units illustrated in FIGS. 7-12 are made from concrete, sometimes with varying degrees of steel reinforcing (depending on the size). They will also be produced in a similar range of sizes.

Figure 7:
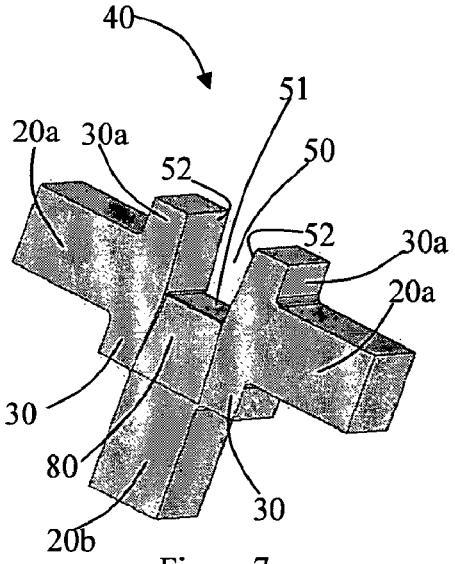
FIGS. 7-12 relate to one preferred embodiment of the present invention. However, it will be clearly understood that the description given below of the embodiment in FIGS. 7-12 is provided for the purposes of illustration and example only, and the invention is not necessarily limited to or by the particular features described.
Figure 8:
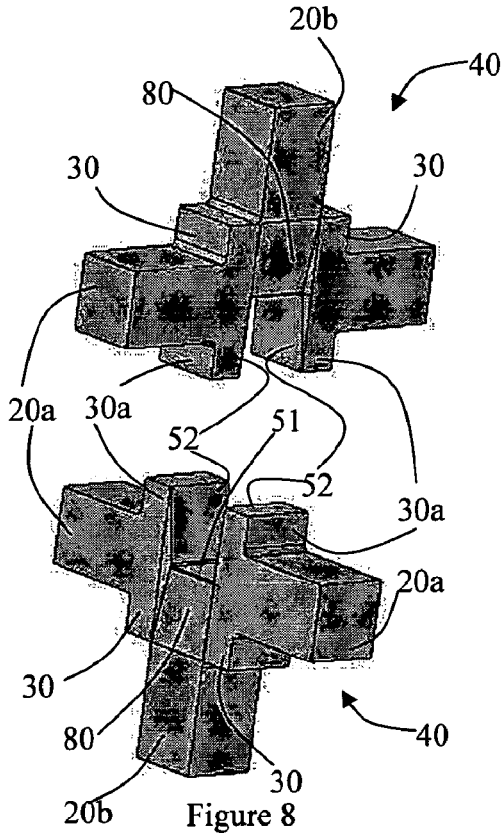
Figure 9:
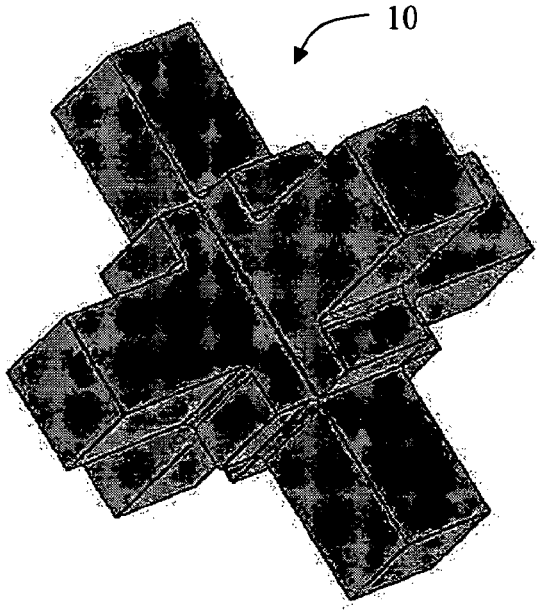
Figure 10:
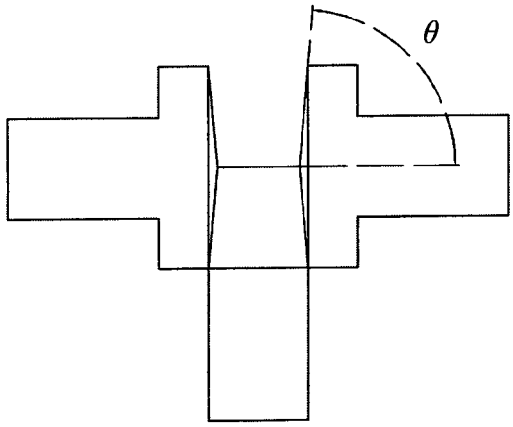

FIG. 9 illustrates the generally symmetrical six-legged shape of the armour unit 10. In FIGS. 7-8, some of the legs are designated 20*a* whilst others are designated 20*b*. The distinction between legs 20*a* and 20*b* is the same as the distinction between the legs 2*a* band 2*b* in the background section above. All of the legs in this embodiment are approximately the same length and thickness, and they all have a generally rectangular cross-section (although in some variations on this embodiment the edges and/or ends of the legs may be rounded or the legs themselves may be curved or some other non-straight overall shape).

Figure 4:
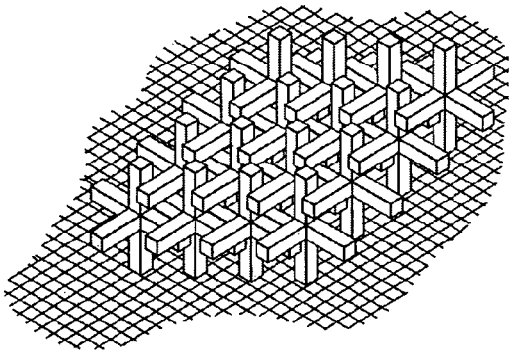
Figure 4 (Prior Art)
Figure 13:
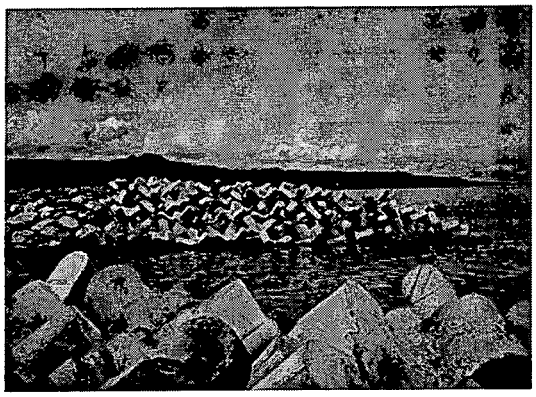
Figure 13 (Prior Art)
FIG. 13 shows a plurality of the prior art armour units of FIG. 1 arranged together at random to create a matrix structure.
Figure 5:
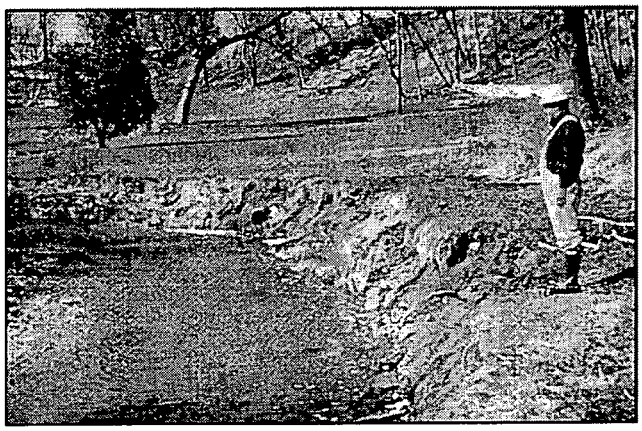
Figure 5 (Prior Art)
Figure 6:
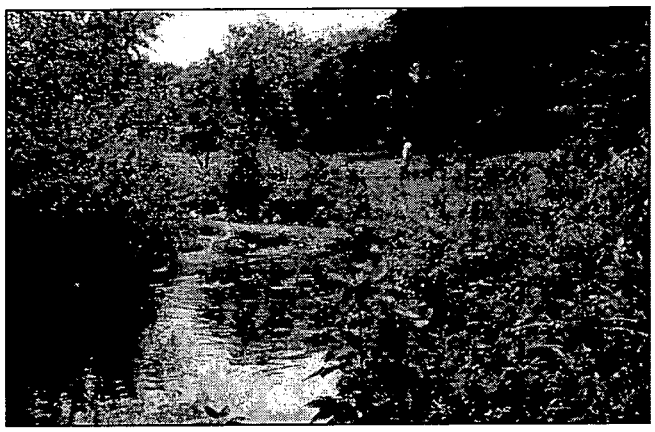
Figure 6 (Prior Art)

In each corner formed by the intersection between a leg 20*a* and a leg 20*b* is a density spacer 30. Each density spacer 30 is a block which is integrally formed with the legs. The armour unit also has a number of additional density spacers 30*a*. The density spacers 30*a* perform the same function as the density spacers 30, but rather than being formed in the corner between legs 20*a* and 20*b* like the density spacers 30, the density spacers 30*a* are integrally formed as blocks protruding from either side of the recess 50. The density spacers 30 and 30*a* function to space the placement of the legs of adjacent armour units when a plurality of the armour units are nested together, as described in the background section above with reference to FIG. 4.

FIG. 8 illustrates that each armour unit 10 in this embodiment is formed from two halves 40. Each half 40 is generally T-shaped with one leg 20*b* forming the stem portion of the T and the other two legs 20*a* together forming the crossbar portion of the T. Both halves 40 are substantially identical. In each half 40, a recess 50 (described further below) is located in the centre of the top surface (i.e. the top "edge") of the crossbar portion, between the two legs 20*a* (and in between the density spacers 30*a*). The two-piece construction of the armour units provides all of the advantages described in the background section above.

In order to assemble two halves 40 to form an armour unit 10, the halves are placed adjacent each other in a crosswise fashioned (as shown in FIG. 8) such that the legs 20*b* of each half are collinear and the crossbar portions of each half are disposed at right angles to each other. As described above, this can be done by hand for smaller units but a crane is required to move the halves 40 of larger units. The halves 40 are then brought together.

Each half 40 shown in FIGS. 7, 8, 10 and 11 has a joining portion which differs in a number of very important ways to the simple square (i.e. parallel sided) recessed notch 5 in the prior art device described above. The joining portion in the embodiment of the invention shown in FIGS. 7, 8, 10 and 11 comprises a recess 50 and receiving portions. In this embodiment, the receiving portions comprise a pair of flat receiving surfaces 80.

The recess 50 is an indented cut-out located between the density spacers 30*a* in each half 40. Each recess 50 is made up of a base surface 51 which is the lowermost (i.e. most deeply indented) part of the recess 50, and a pair of the sidewalls 52, one extending from either side of the base surface 51. The sidewalls 52 are flat surfaces which extend from the base surface 51 to the top edge of each of the density spacers 30*a*. Importantly, the sidewalls diverge away from each other slightly as they extend from the base surface 51 to the top edges of the density spacers 30*a*. Hence, the distance between the sidewalls is minimum at the base surface 51 and maximum between the top surfaces of adjacent density spacers 30*a*. The angle of slope of the sidewalls 52 is labelled θ in FIG. 10. In this particular embodiment, θ is approximately 85° (meaning that the angle of slope of each sidewall 52 is approximately 5° relative to the longitudinal axis of leg 20*b*). However, it would be appreciated that this angle may be varied to suit the design in different embodiments of the invention.

As noted above, the joining portion of each half 40 also includes a pair of flat receiving surfaces 80. Each receiving surface 80 connects along one of its edges to the base surface 51 of the recess. The opposite edge of each receiving surface 80 connects with the side surface of the component (i.e. the face on either side of the half 40). The receiving surfaces 80 slope so as to diverge relative to each other. However, whereas the sidewalls 52 of the recess 50 diverge as they move in the direction from the base surface 51 towards the outer edges of the density spacers 30*a*, in contrast the receiving surfaces 80 diverge as they move in the opposite direction (i.e. as they move in the direction of away from the density spacers 30*a* towards leg 20*b*). Nevertheless, the angle of slope of the receiving surfaces 80 is the same as the angle of slope of the sidewalls 52 (i.e. approximately 5° relative to the longitudinal axis of the leg 20*b* in this embodiment).

Figure 11:
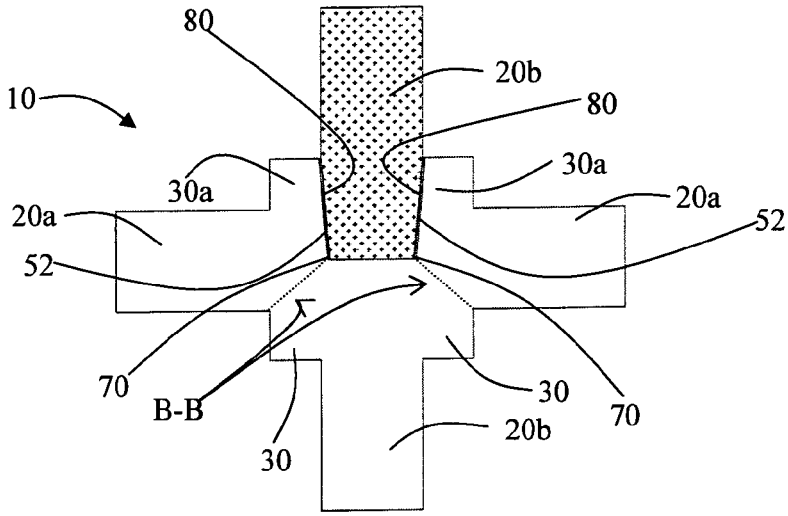

FIG. 11 is a cross-sectional view of the unit of FIG. 9 after the two halves have been brought together. The lower half is shown in a cross-sectional plan orientation. The upper half is partially shown in cross-section (only the cross-section of its leg 20*b* is visible). The cross-section of the upper half's leg 20*b* is shaded with dots to distinguish it from the cross-section of the lower half.

Prior to bringing the respective halves 40 together as shown in FIG. 11 (i.e. while the halves 40 are still separated as shown in FIG. 8), a bonding medium is applied to the joining portion of one or both halves. The bonding medium could be a spray on epoxy, plastic cement or traditional grout, and the bonding medium will preferably be applied to the sloping sidewalls 52 and/or receiving surfaces 80 of one or both halves 40. However, as noted above, the joining portions of the components (the halves 40 in this case) should be configured so that, if the two halves 40 were brought together without applying any bonding material, a small space would remain between the sidewalls 52 and receiving surfaces 80 of one half 40 and the receiving surfaces 80 and sidewalls 52 respectively of the other half 40, even when the halves come together fully so that the base surfaces 51 of the halves abut with each other. The width of this space would be considerably less than 10 mm, preferably 2-3 mm. It has already been explained that the small width of this space creates the beneficial squeezing which forces the bonding material into the nooks and crannies in between the halves and which squeezes excess material out from in between.

This small space which would exist if the halves were brought together without the bonding material also serves an additional purpose. It helps to ensure that, when the two halves are brought together, the receiving surfaces 80 of one half, which insert between the sidewalls 52 of the other half, do not push outwardly on the side walls 52 of the latter half, and vice versa. This helps to minimise the risk of creating potentially damaging stresses (particularly tensile stresses) in the concrete. In addition to this, it will be observed by comparing FIG. 11 with FIG. 3 that the thickness of the concrete along the plane B-B in FIG. 11 is greater than the thickness of the material along the plane A-A in FIG. 3. The angle formed by the corner 70 in FIG. 11 is also more obtuse than the angle formed by the corner 7 in FIG. 3, meaning that the severity of the potential stress concentration caused by the corner 70 is less. Consequently, the embodiment of the present invention shown in FIGS. 7-11 is far less brittle than the prior art device described in the background section above. These are all additional benefits which the present invention achieves through the use of the outwardly diverging (or inwardly converging) slope of the sidewalls 52.

Each half 40, when made of concrete, is typically formed using a "cookie cutter" construction. This involves pouring concrete into a mould. The mould should have the same perimeter shape as the half 40. More specifically, the sidewalls of the mould which define the volume into which the concrete is to be poured should form a shape that corresponds with the shape of the perimeter edge of each half 40 (for example the shape of the perimeter of edge of the half 40 shown in FIG. 10). The half 40 therefore obtains its overall shape by being poured into the mould and being allowed to set therein.

Figure 12:
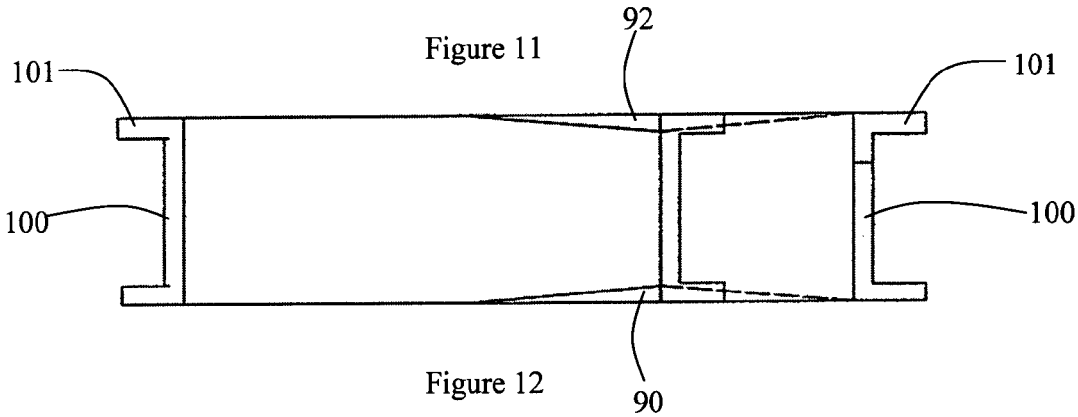

FIG. 12 shows a cross-sectional view through the mould. It will be noticed that the sidewalls 100 of the mould have outwardly extending flanges 101. The flanges 101 provide the sidewalls of the mould with structural rigidity. This helps to prevent buckling or other deformation of the mould walls when the concrete is initially poured.

The receiving surfaces 80 of each half 40 are formed by inserts which are separate from the rest of the mould. In FIG. 12 one of the inserts is indicated by reference numeral 90 and the other incident is indicated by reference numeral 92. In certain 90 is actually positioned in the mould before the concrete is poured. After the insert 90 is correctly positioned, the concrete is then poured into the mould, and finally be second in certain 92 is forced into the surface of the poured concrete. The concrete is then allowed to set. After the concrete has set, the sidewalls of the mould "stripped" leaving a freestanding concrete component, and the inserts and 90, 92 are removed leaving behind indented sloping receiving surfaces 80.

It will be appreciated by those skilled in the art that various other changes and modifications may be made to the embodiment just described without departing from the spirit and scope of the invention.

The invention claimed is:

1. An erosion protection device for protecting or reinforcing natural and man-made structures against water erosion, said erosion protection device comprising:

at least two components, each said component having an edge, surfaces on respective sides of said edge and at least one joining portion, wherein said joining portion of said component further comprising a recess defined in said edge and receiving portions on respective sides of said edge;

wherein each said recess having a base which is recessed relative to said edge, and sidewalls which diverge as they extend from said base out to said edge; and wherein said receiving portions diverge relative to each other with substantially the same slope as said sidewalls as they extend from adjacent said base of said recess away from said edge towards the respective surfaces, whereby when joining two of said components a bonding medium is applied to said joining portion on at least one of said components, and said joining portions are brought together such that a space between said sidewalls and receiving portions of one said component and said receiving portions and sidewalls respectively of the other said component diminishes thereby squeezing said bonding medium therebetween as said components come together.

2. The erosion protection device as set forth in claim 1, wherein said joining portions of said components are configured so that when said joining portions of two of said components were brought together a space would remain between said sidewalls and receiving portions of one of said components and said receiving portions and sidewalls respectively of the other of said components when said components came together fully.

3. The erosion protection device as set forth in claim 2, wherein said space would be less than 10 mm wide.

4. The erosion protection device as set forth in claim 3, wherein said space would be less than 5 mm wide.

5. The erosion protection device as set forth in claim 4, wherein said bonding medium is selected from the group consisting of spray on epoxy, epoxy impregnated fabrics, plastic cements, and grout.

6. The erosion protection device as set forth in claim 5, wherein each said component is made of concrete.

7. The erosion protection device as set forth in claim 6, wherein said concrete further comprising steel reinforcing.

8. The erosion protection device as set forth in claim 7, wherein said components each being multi-legged components comprising multiple legs, when joined, form a multi-legged device.

9. The erosion protection device as set forth in claim 8, wherein said legs of said multi-legged device are all of the same length and shape.

10. The erosion protection device as set forth in claim 1, wherein each said component has a three legged T-shape such that, when two of said components are joined, said device has a substantially six-legged "jack" configuration.

11. The erosion protection device as set forth in claim 1, wherein said sidewalls of said recess are flat surfaces.

12. The erosion protection device as set forth in claim 1, wherein said receiving portions comprising a pair of flat receiving surfaces.

13. The erosion protection device as set forth in claim 1, wherein at least one of said components further comprising at least one lifting hook protruding therefrom.

14. An erosion protection device comprising:

at least one component having a substantially T-shape configuration, said component comprising:

a plurality of legs, with at least one leg forming a stem portion and at least two legs forming a crossbar portion;

an edge, surfaces on respective sides of said edge and at least one joining portion, wherein said joining portion further comprising a recess and receiving portions on respective sides of said edge, said recess being defined in a centre of a top surface of said crossbar portion between said two legs of said crossbar portion, said recess having a base surface which is a lowermost part of said recess, and a pair of sidewalls one of which extending from either side of said base surface, a block integrally formed at each intersection of said legs of said stem portion and said crossbar portion; and an additional block integrally formed with said two legs of said crossbar portion and protruding from either side of said recess opposite said stem portion;

wherein said receiving portions being a pair of flat receiving surfaces each of which connects along one of its edges to said base surface of said recess, an opposite edge of each said receiving surface connects with a side surface of said component;

wherein said sidewalls of said recess being flat surfaces which extend from said base surface to a top edge of each of said blocks, said sidewalls diverge away from each other as they extend from said base surface to said top edges of said blocks;

wherein said receiving surfaces on respective sides diverge with substantially the same slope as said sidewalls as said receiving surfaces extend from adjacent said base of said recess away from said additional block towards said leg of said stem portion.

15. The erosion protection device as set forth in claim 14, wherein said component is at least two components, said joining portions of said components are configured so that when said joining portions of two of said components are brought together a space would remain between said sidewalls and receiving portions of one of said components and said receiving portions and sidewalls respectively of the other of said components when said components came together fully.

16. The erosion protection device as set forth in claim 15, wherein said space would be less than 10 mm wide.

17. The erosion protection device as set forth in claim 16, wherein said space would be less than 5 mm wide.

18. The erosion protection device as set forth in claim 14, wherein said legs are all of the same length and shape.

19. A method for joining two components of an erosion protection device, said method comprising the steps of:

providing at least two components each comprising an edge, surfaces on respective sides of said edge and at least one joining portion, wherein said joining portion of at least one of said components comprises a recess in said edge and receiving portions on respective sides of said edge, wherein each said recess has a base which is recessed relative to said edge, and sidewalls which diverge as they extend from the base out to said edge, and said receiving portions on respective sides diverge with substantially the same slope as said sidewalls as said receiving portions extend from adjacent said base of said recess away from said edge towards the respective side surfaces;

applying a bonding medium to said joining portion on at least one of said components; and forming a join by bringing said joining portions of said two components together such that a space between said sidewalls and receiving portions of one component and said receiving portions and sidewalls respectively of the other component diminishes thereby squeezing said bonding medium therebetween as said components come together.

20. The method as set forth in claim 19, wherein the squeezing assists in distributing said bonding medium between said sidewalls of one component than receiving portions of the other component.

* * * * *